US008534472B2

(12) United States Patent
Levine et al.

(10) Patent No.: US 8,534,472 B2
(45) Date of Patent: Sep. 17, 2013

(54) SPINNING TOWER RACK

(75) Inventors: Daniel E. Levine, Madison, WI (US); Fred C. Stancer, III, Randolph, WI (US); Alan C. Atwood, Madison, WI (US)

(73) Assignee: Universal Presentation Concepts, Madison, WI (US)

( * ) Notice: Subject to any disclaimer, the term of this patent is extended or adjusted under 35 U.S.C. 154(b) by 0 days.

(21) Appl. No.: 12/883,802

(22) Filed: Sep. 16, 2010

(65) Prior Publication Data

US 2011/0062094 A1 Mar. 17, 2011

Related U.S. Application Data

(60) Provisional application No. 61/243,021, filed on Sep. 16, 2009.

(51) Int. Cl.

| | |
|---|---|
| ***A47F 5/02*** | (2006.01) |
| ***A47F 3/14*** | (2006.01) |
| ***A47J 47/00*** | (2006.01) |

(52) U.S. Cl.

USPC ..... 211/163; 211/131.1

(58) Field of Classification Search

USPC ..... 211/85.2, 85.1, 58, 163, 50, 183, 211/26, 189, 53, 70, 129.1, 131.1, 196, 205, 211/144, 40, 55, 52; 40/124.19, 124, 124.2, 40/124.4; 206/745, 748, 503, 509; 220/480; 312/125, 126, 135

See application file for complete search history.

(56) References Cited

U.S. PATENT DOCUMENTS

| | | | | | |
|---|---|---|---|---|---|
| 766,629 | A | * | 8/1904 | Koeher | 211/58 |
| 838,294 | A | * | 12/1906 | Zeiner | 211/58 |
| 1,677,318 | A | * | 7/1928 | Alexander | 211/58 |
| 1,908,928 | A | * | 5/1933 | Stein | 211/78 |
| 2,678,253 | A | * | 5/1954 | Rosenberg | 312/285 |
| D176,004 | S | * | 11/1955 | Brooks | D6/476 |
| 2,726,803 | A | * | 12/1955 | Ketler | 229/5.5 |
| 2,738,075 | A | * | 3/1956 | Guignard et al. | 211/56 |
| 3,187,924 | A | * | 6/1965 | Marcus | 220/480 |
| 3,223,247 | A | * | 12/1965 | Bleed | 211/163 |
| 3,243,047 | A | * | 3/1966 | Witteborg | 211/41.1 |
| 3,292,797 | A | * | 12/1966 | Berk | 211/163 |
| 3,379,304 | A | * | 4/1968 | Mertz | 206/600 |
| 3,543,943 | A | * | 12/1970 | Joy et al. | 211/131.1 |
| 3,656,611 | A | * | 4/1972 | Mertz | 206/764 |
| 3,844,230 | A | * | 10/1974 | Hudson et al. | 108/60 |
| 3,942,647 | A | * | 3/1976 | Crosslen | 211/144 |
| 3,957,159 | A | * | 5/1976 | Radek | 211/4 |
| 4,126,366 | A | * | 11/1978 | Handler et al. | 312/249.2 |
| 4,150,752 | A | * | 4/1979 | Breining et al. | 211/85.1 |
| D261,829 | S | * | 11/1981 | Brand | D6/461 |
| 4,548,324 | A | * | 10/1985 | Mackey, Jr. | 211/58 |
| 4,586,619 | A | * | 5/1986 | Eckert | 211/189 |
| 4,718,561 | A | * | 1/1988 | Eckert | 211/85.1 |
| 4,723,666 | A | * | 2/1988 | Nichols | 211/189 |

(Continued)

*Primary Examiner* — Darnell Jayne
*Assistant Examiner* — Kimberly S Wright
(74) *Attorney, Agent, or Firm* — Charles S. Sara, Esq.; Daniel A. Blasiole; DeWitt Ross & Stevens, S.C.

(57) ABSTRACT

A tower rack for holding greeting cards and the like is described. The rack includes a tower assembly structure which includes at least one panel section consisting of one or more side panels. Each side panels is configured with horizontal and vertical slits for holding merchandise trays. A base is configured to fit snugly to the bottom of the tower assembly structure.

18 Claims, 7 Drawing Sheets

(56) References Cited

U.S. PATENT DOCUMENTS

| | | | | | |
|---|---|---|---|---|---|
| D295,807 | S | * | 5/1988 | Kyler | D6/457 |
| 4,850,658 | A | * | 7/1989 | Sandor | 312/225 |
| 4,976,359 | A | * | 12/1990 | Hardy | 211/58 |
| 5,052,563 | A | * | 10/1991 | Camp | 211/85.2 |
| 5,054,624 | A | * | 10/1991 | Camp | 211/85.2 |
| 5,096,073 | A | * | 3/1992 | O'Brien | 211/163 |
| 5,255,801 | A | * | 10/1993 | Berger | 211/131.1 |
| 5,257,703 | A | * | 11/1993 | Ascik et al. | 211/166 |
| 5,267,656 | A | * | 12/1993 | Nichols | 211/85.1 |
| 5,472,100 | A | * | 12/1995 | Garrison et al. | 211/45 |
| 5,715,955 | A | * | 2/1998 | Hannecke | 211/163 |
| 5,772,055 | A | * | 6/1998 | Orr et al. | 211/186 |
| 6,026,951 | A | * | 2/2000 | Ovadia et al. | 206/6.1 |
| D436,265 | S | * | 1/2001 | Kidd et al. | D6/457 |
| 6,302,285 | B1 | * | 10/2001 | Fulle | 211/189 |
| 6,378,710 | B1 | * | 4/2002 | Grueneberg | 211/132.1 |
| 6,405,879 | B1 | * | 6/2002 | Fox | 211/50 |
| 6,504,100 | B2 | * | 1/2003 | Lawrence et al. | 174/100 |
| 6,915,914 | B2 | * | 7/2005 | Farrand | 211/163 |
| 6,929,133 | B1 | * | 8/2005 | Knapp et al. | 211/118 |
| D526,817 | S | * | 8/2006 | Gratiot | D6/455 |
| 7,497,332 | B1 | * | 3/2009 | Schwimmer | 206/600 |
| 7,753,218 | B2 | * | 7/2010 | Moss et al. | 211/133.3 |
| 2002/0000417 | A1 | * | 1/2002 | Kidd et al. | 211/85.1 |
| 2006/0186063 | A1 | * | 8/2006 | Campbell | 211/55 |
| 2007/0235396 | A1 | * | 10/2007 | Moss et al. | 211/72 |
| 2008/0083682 | A1 | * | 4/2008 | Moss et al. | 211/72 |
| 2009/0140118 | A1 | * | 6/2009 | Moss et al. | 248/423 |

* cited by examiner

SPINNING TOWER RACK

REFERENCE TO RELATED APPLICATION

The application claims priority to U.S. Provisional Application entitled "Spinning Tower Rack," Ser. No. 61/243,021, filed Sep. 16, 2009, which is incorporated herein by reference in its entirety.

FIELD OF THE INVENTION

The present invention is directed to a spinning tower rack used to exhibit cards or other items on a rotating display.

DESCRIPTION OF THE PRIOR ART

Greeting card displays in retail stores take many forms and are generally designed to provide the customer with a wide variety of cards and other merchandise preferably in a compact arrangement and in a manner to minimize the space requirements for the display. Most displays are typically presented as successive rows of card shelves along the wall of a store or in back-to-back fashion. The displays include a front panel, rear panel, two side panels and elevating rows of "card slots" such the customer will be able to view as many cards as possible. In such cases, the spacing of the shelves and card slots is constant. Therefore, there is not much flexibility in the manner the cards can be displayed.

A disadvantage of such displays is that they take up quite a bit of foot space in the retail stores. Another disadvantage is that the customer must typically move down the length of the display case in order to view all the cards. This length can sometimes cover several feet.

It is therefore a need in the card display industry to provide a suitable replacement display device which answers to the wholesale/retail/consumer needs to best promote the sale of the product displayed in a minimal amount of square footage.

SUMMARY OF THE INVENTION

The present invention is directed to a tower rack for holding greeting cards and the like. The tower rack comprises a tower assembly structure having an open first upper end and an open second lower end, wherein the tower assembly structure comprises at least one panel section, wherein the panel section comprises at least one side panel, each side panel having a vertical border on either side of the side panel, wherein the side panel comprises horizontal slits and vertical slits wherein the vertical slits are placed periodically along the vertical length of the panel section; and a base configured to fit snugly around the second open end of the tower assembly structure.

The present invention is also directed to a spinning tower rack which comprises a tower assembly structure having an open first upper end and an open second lower end. The tower assembly structure comprises at least one panel section, wherein the panel section comprises at least one side panel, each side panel having a vertical border on either side of the side panel, wherein the side panel comprises horizontal slits and vertical slits wherein the vertical slits are placed periodically along the vertical length of the panel section, wherein the vertical slits are placed periodically along the vertical borders of the side panels, wherein the horizontal slits and vertical slits are placed such that two vertical slits correspond with each horizontal slit, with the vertical slits being placed above and on each side of the horizontal slit. A base is configured to fit snugly around the second open end of the tower assembly structure, wherein the base is a spinning base, the spinning base including a spinning member rotationally connected to a fixed member on the base. The spinning tower rack also includes removable trays, wherein the trays are reversibly attached to the side panels for holding merchandise.

The present invention is also directed to a tower rack assembly comprising at least two tower racks fitted onto a common base platform. Each tower rack comprises a tower assembly structure having an open first upper end and an open second lower end, wherein the tower assembly structure comprises at least one panel section, wherein the panel section comprises at least one side panel, each side panel having a vertical border on either side of the side panel, wherein the side panel comprises horizontal slits and vertical slits wherein the vertical slits are placed periodically along the vertical length of the panel section; and a base configured to fit snugly around the second open end of the tower assembly structure.

The display described is an innovative design which answers to the wholesale/retail/consumer needs to best promote the sale of the product displayed in a minimal amount of square footage. Its creation features elegance of design, simplicity of assembly, extreme durability and most importantly an uninterrupted view or encumbrance of the product displayed.

The objects and advantages of the invention will appear more fully from the following detailed description of the preferred embodiment of the invention made in conjunction with the accompanying drawings.

DETAILED DESCRIPTION OF THE INVENTION

Figure 1:
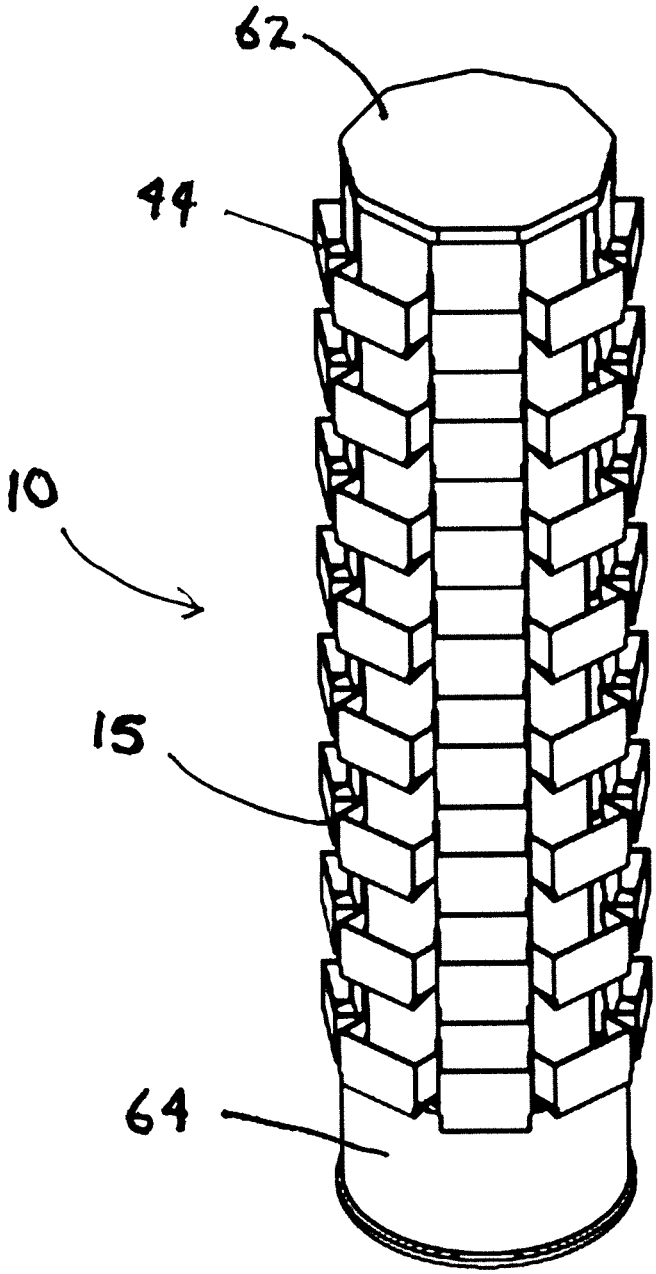
FIG. 1 is a perspective view of the spinning tower rack of the present invention.
Figure 2:
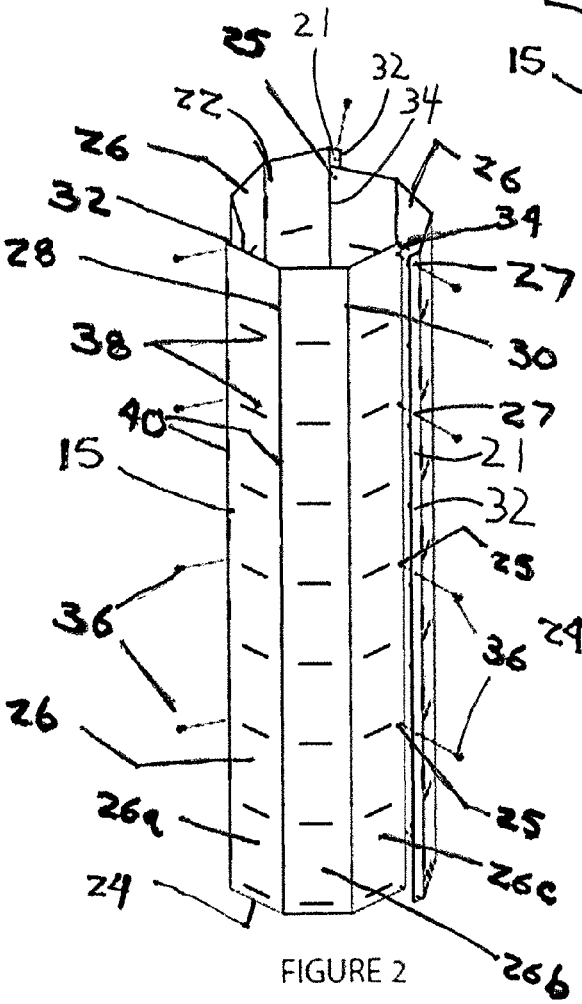
FIG. 2 is a perspective view illustrating a first step in constructing the spinning tower rack of FIG. 1.
Figure 3:
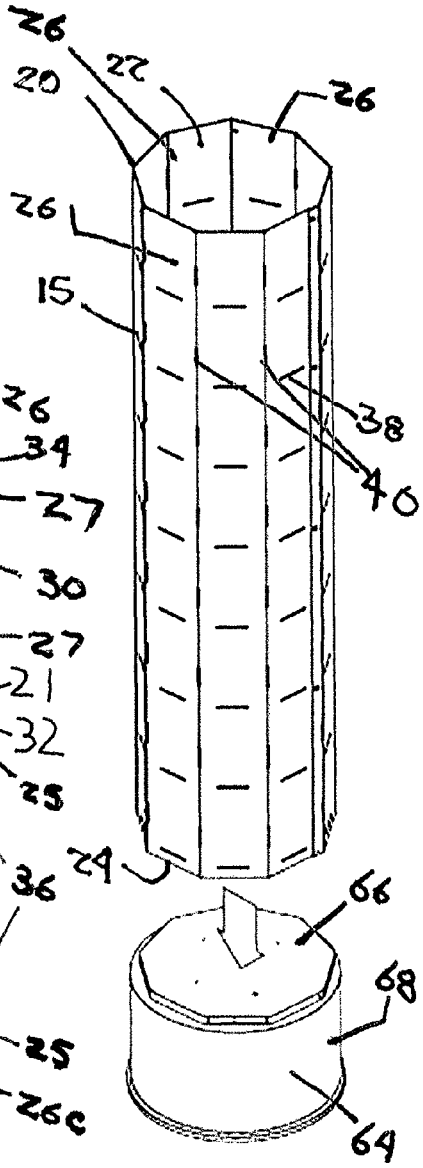
FIG. 3 is a perspective view illustrating a second step in constructing the spinning tower rack of FIG. 1.
Figure 4:
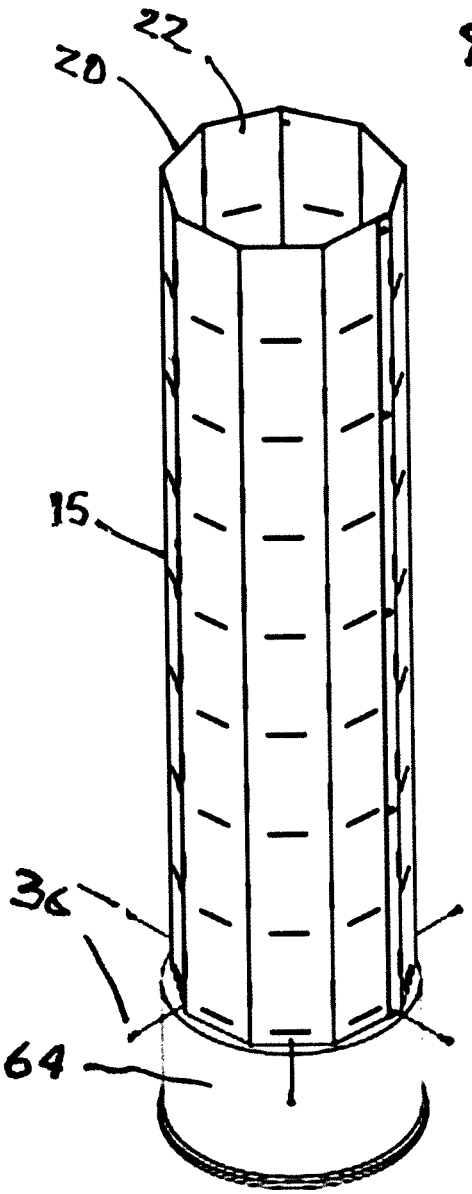
FIG. 4 is a perspective view illustrating a third step in constructing the spinning tower rack of FIG. 1.
Figure 5:
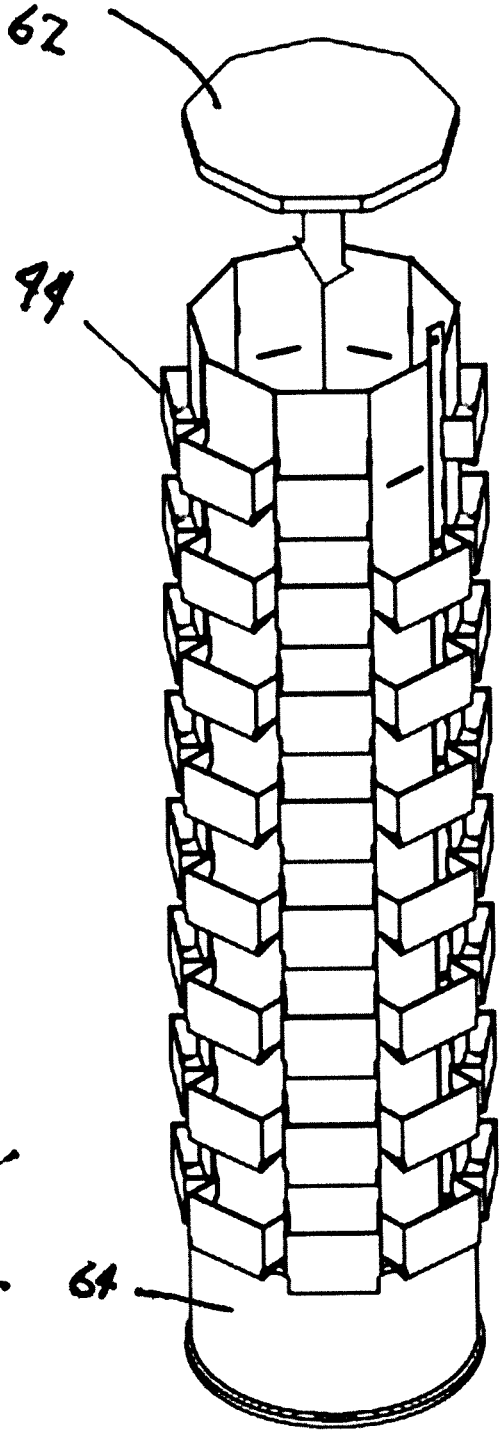
FIG. 5 is a perspective view illustrating a fourth step in constructing the spinning tower rack of FIG. 1.

Referring now to FIGS. 1-6, there is illustrated a single spinning tower rack 10 of the current invention, which most generally includes a tower assembly 15, a cap or top portion 62 and a bottom portion or base 64. The tower assembly 15 includes a tower prism 20. The tower prism 20 takes the geometric form of a multi-sided prism tube with open ends 22, 24. FIGS. 1-6 illustrate the tower prism 20 as a nonagon (9-sided) prism. However, the tower prism 20 may have any number of sides, including 3, 4, 5, etc., or even 0 sides in the case of a cylindrical tube form. As illustrated in FIG. 2, the tower prism 20 is comprised of three identical panel sections 26 that connect together in a daisy chain fashion to each other. Each panel section 26 is formed with three faceted side panels 26*a*, 26*b*, and 26*c*connected at borders 28 and 30. The three faceted panels 26 combine to form the sides of the tower prism 20. The attachment of the three panels 26 is achieved by overlapping a flap 21 of the vertical edge 32 of one faceted panel 26 with the opposite vertical edge 34 of the next panel 26. The overlapping flap 21 of vertical edge 32 contains apertures 27 placed along its length that mirrors the vertical placement of apertures 25 of the edge 34. The tower prism 20 is assembled by applying fasteners 36 through these apertures 25 into the corresponding apertures 27 in the panels 26 such that the vertical edges 32, 34 of the panels 26 are joined end-to-end in a manner to generate the appropriate number of sides of the intended shape of the tower prism 20. The attachment of the panels 26 can also be achieved without fasteners such as in a slot and tab method or another fastenerless method.

The tower prism 20 may be comprised of any suitable number of panel sections 26 with each panel section 26 having any suitable number of prism sections or facets. For ease of manufacturing, it is preferred that the number of panel sections 26 be evenly divisible by the number of sides of the fully-assembled tower prism 20. This allows each panel section 26 comprising the tower prism 20 to contain the same number of panel sections. For example, the nonagon tower prism 20 shown in FIGS. 1-6 contains three panel sections 26 with each panel section 26 containing three side panels 26*a*, 26*b*, 26*c*. An octagonal tower prism (not shown) would contain two panel sections, with each panel section containing four prism panels. However, any combination is possible and is envisioned by the present invention. In versions with only one panel section, the panel section includes prism panels corresponding to the number of sides of the fully-assembled tower prism and further includes an attachment section. In yet other versions, the tower prism may extrude as a single unit.

Referring again to FIGS. 2-4, each panel 26 of the tower prism 20 comprises horizontal slits 38 and vertical slits 40. The horizontal slits 38 are placed periodically along the vertical length of the side panels 26*a*, 26*b*, and 26*c*. The vertical slits 40 are placed periodically along the vertical borders 28 and 30. The horizontal slits 38 and vertical slits 40 are placed such that two vertical slits 40 correspond with each horizontal slit 38, with the vertical slits 40 being placed above and on each side of the horizontal slit 38. The panel sections 26 can be made of any rigid material but are preferably made of a plastic material. Other materials include polycarbonate, wood, tin, steel, and cardboard.

Referring now to FIGS. 1, 5, and 6-8, the tower assembly 15 further comprises trays 44 or other attachments reversibly attached to the tower prism 20 for holding merchandise. The trays 44 are comprised of a single piece of material and are preferably plastic, but may be made of other materials as described above with respect to the panels 26. The trays 44 may also be formed of shaped wire.

Figure 6:
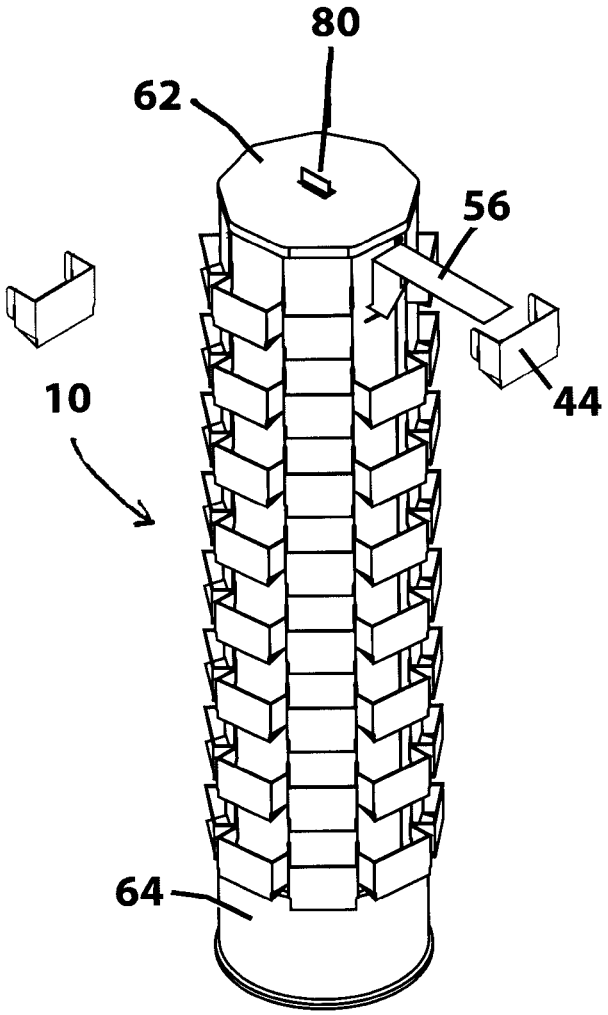
FIG. 6 is a perspective view illustrating a fifth step in constructing the spinning tower rack of FIG. 1.
Figure 7:
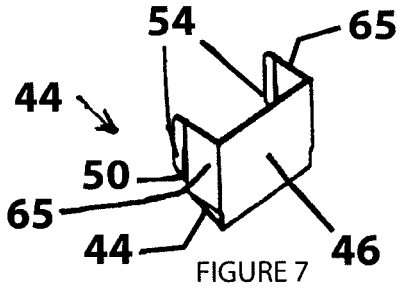
FIG. 7 is a perspective view illustrating a first embodiment of a shelf unit for the spinning tower rack.
Figure 8:
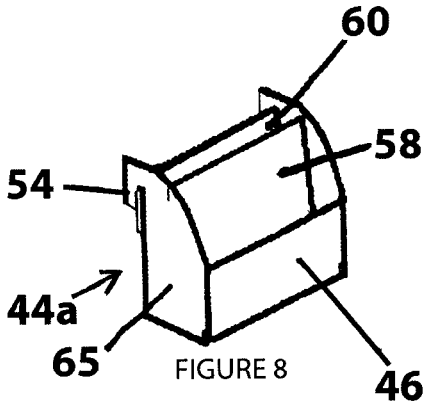
FIG. 8 is a perspective view illustrating a second embodiment of a shelf unit for the spinning tower rack.
Figure 9:
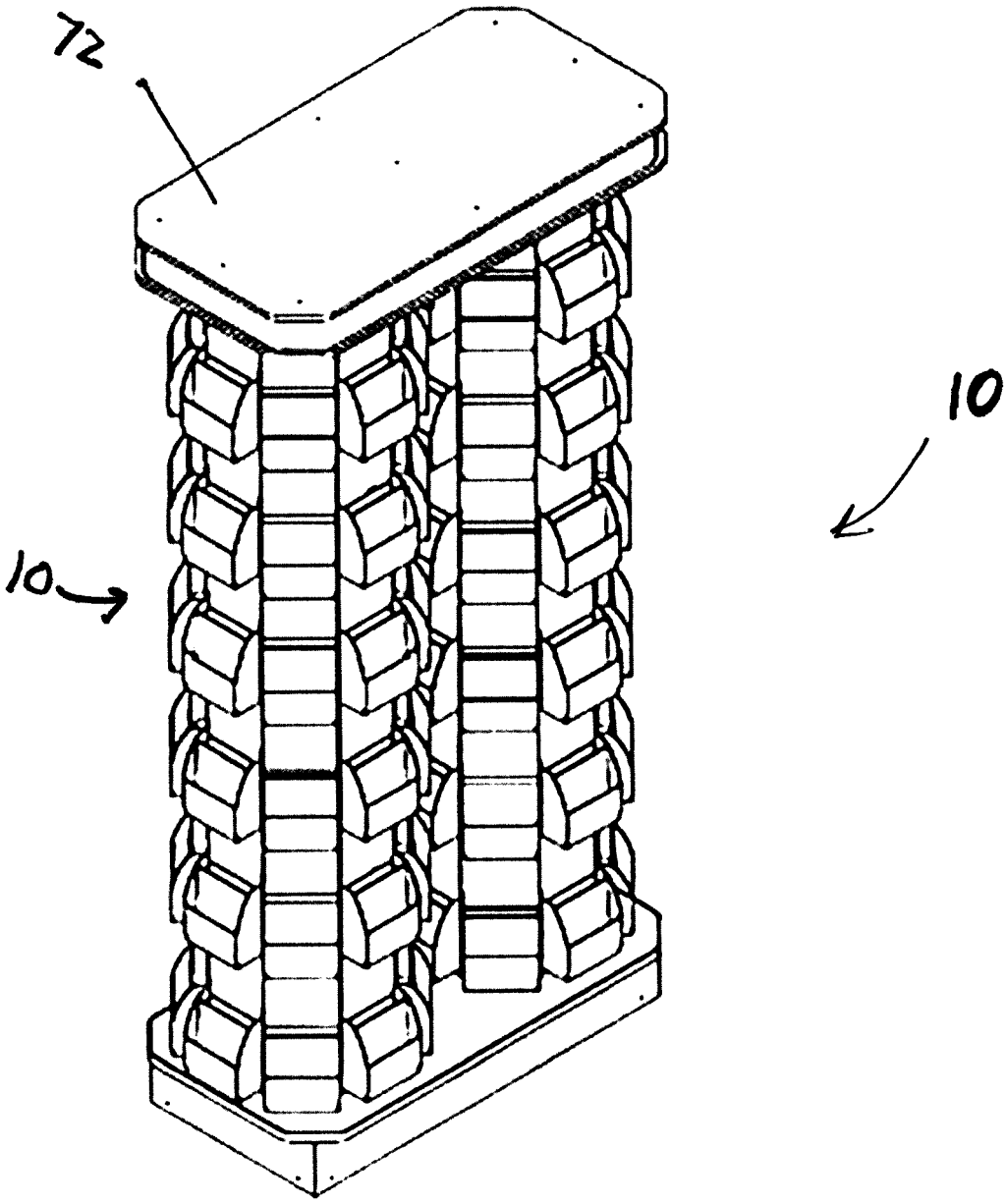
FIG. 9 is a perspective view illustrating a second embodiment of a spinning tower rack.

As illustrated in FIGS. 7-8, the trays 44 include a front surface 46, a bottom flap 48 with a flange 50, and two side flaps 65, with each side flap 65 containing a side hook 54. The trays 44 are attached to the tower prism 20 by inserting side flaps 65 into the vertical slits 40, sliding the tray 44 downward so that the hooks 54 engage the portion of the panel section 22 underneath the vertical slits 40, and inserting the flange 50 into the horizontal slit 38 (illustrated by arrow 56 in FIG. 6).

As illustrated in FIG. 8, the pocket tray 44*a* may also be comprised of more than a single compartment for holding merchandise. Tray 44*a* is divided into two tiered pockets or compartments 58, 60 to display the merchandise. Tray 44*a* could also be configured to contain three or four compartments and or tiers.

Referring now to FIGS. 1-3, 5 and 6, the tower rack 10 may also include a cap 62 and/or a base 64. The cap 62 and the base 64 may be configured to fit snugly around the first and second open ends 22, 24 of the tower prism 20, respectively. Alternatively, the cap 62 and/or base 64 may be configured to insert within the open ends 22, 24 of the tower prism 20. In the latter case, the cap 62 and base 64 may have lower recessed portions, which insert snugly within the open ends 22, 24 of the tower prism 20. The extended portions are either flush with the outer perimeter of the tower prism 20 or extend beyond it. Whether the cap 62 and/or base 64 are configured to fit around the ends 22, 24 of the tower prism 20 or insert within the open ends 22, 24, the cap 62 and base 64 are secured to the tower prism 20 using any type of fastener known in the art. Preferably, sheet metal screws are used for fastening. The cap 62 and base 64 may alternatively be secured by friction fit only.

Referring to FIGS. 1 and 3-6, the tower rack 10 may also include a spinning base 64. The spinning base 64 includes a spinning member 66 rotationally connected to a fixed member 68. The spinning member 66 is configured and dimensioned to fit snugly within the lower open end of the tower prism 20. The tower prism 20 is fastened to the spinning member 66 so that the tower prism 20 contacts the spinning member 66, but not the fixed member 68. The tower prism 20 can be fastened to the spinning member 66 by any means known in the art, but fastening with sheet metal screws is preferred. The weight of the tower prism 20 is supported entirely by the spinning member 66 of the spinning base 64. This is enabled through the combination of the friction fit between the tower prism 20 and the spinning member 66 and the fasteners. A spinning tower rack 10 that includes a spinning base 64 is capable of rotating around the longitudinal axis of the tower prism 20, wherein the spinning member 66 and the tower prism 20 rotate as a unit with respect to the fixed member 68 of the spinning base 64. The tower prism assembly may also be hung on a vertical display pole and base rather than base 64.

Figure 10:
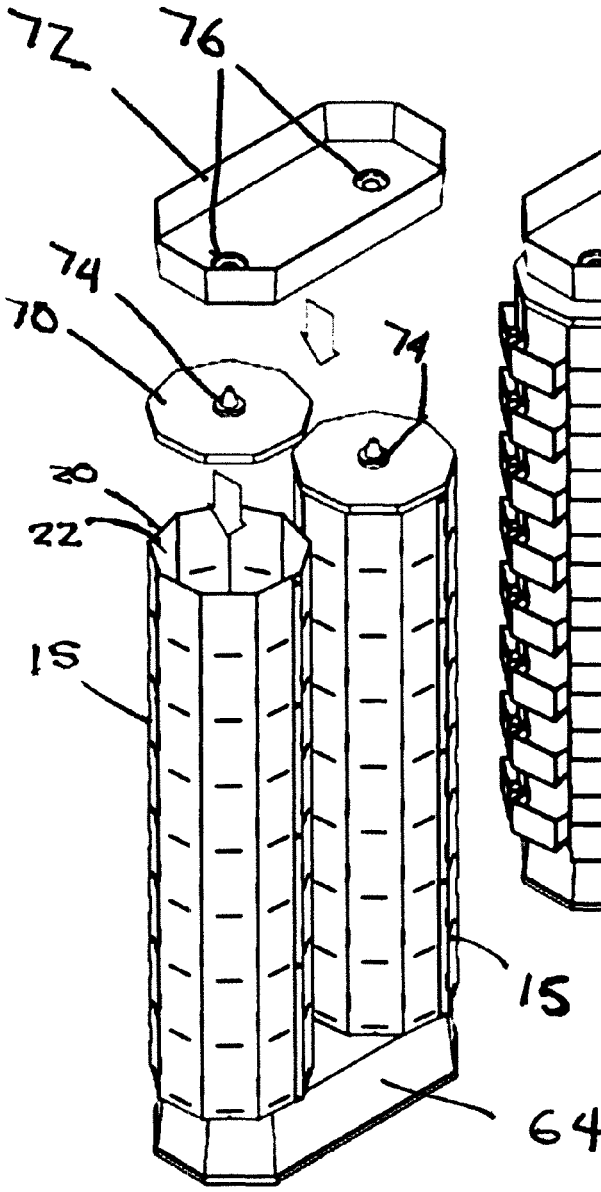
FIG. 10 is an exploded perspective view of the spinning tower rack of FIG. 9.
Figure 12:
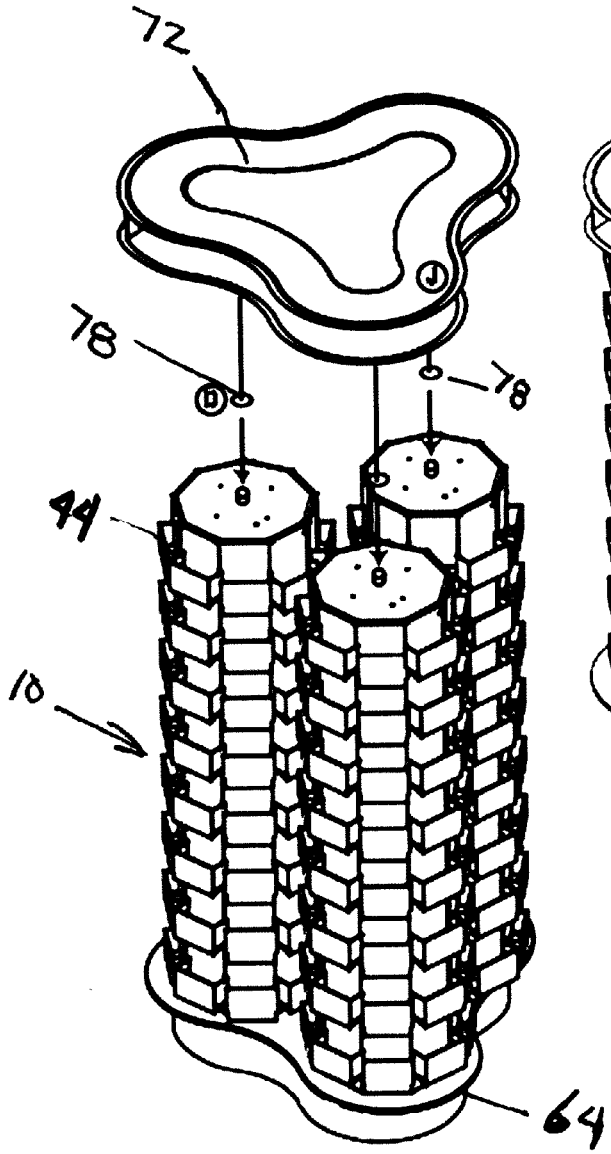
FIG. 12 is an exploded perspective view illustrating a third embodiment of a spinning tower rack.
Figure 13:
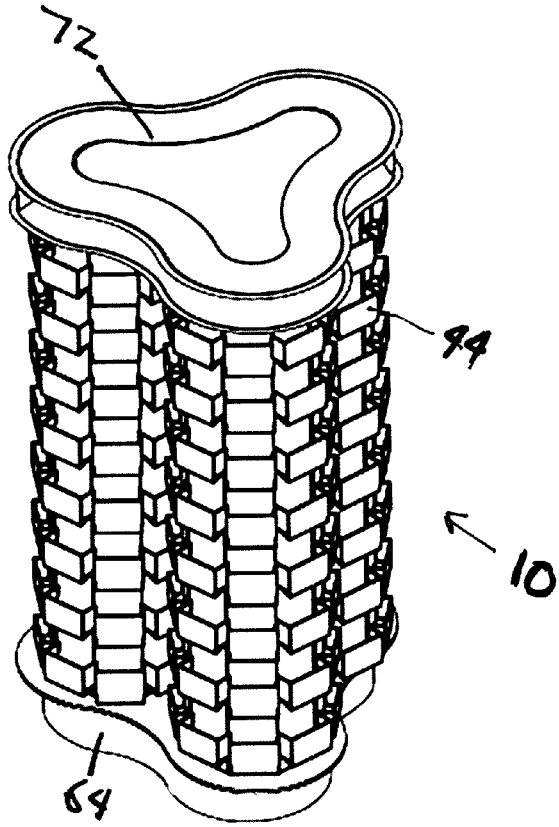
FIG. 13 is a perspective view illustrating the spinning tower rack of FIG. 12.

As shown in FIGS. 10 and 12, with respect to other embodiments of the tower rack, the spinning tower racks 10 may further include spinning caps 70 and a header 72. The spinning cap 70 contains the same structural elements as the cap 62 except that it further comprises a locator pin 74. The locator pin 74 is either fixedly or rotationally attached to the top-center of the spinning cap 70. The locator pin 74 is received in a locator-pin receiving hole 76 in the header 72, the latter of which serves as the uppermost portion of the spinning tower rack 10. The locator pin 74 and locator-pin receiving hole 76 are coordinately structured so that the locator pin 74 can spin freely within the locator-pin receiving hole 76. A "lazy Susan"-type ball bearing 78, illustrated in FIG. 12, may be inserted around the locator pin 74 and between the spinning cap 70 and the header 72 to help the spinning cap 70 to rotate freely with respect to the header 72. A spinning tower rack 10 comprising a spinning base 64, a spinning cap 70, and a header 72 are capable of spinning around the longitudinal axis of the tower prism 20. The spinning member 66 of the spinning base 64, tower prism 20, and spinning cap 70 rotate as a unit with respect to the fixed member 68 of the spinning base 64 and the header 72.

As shown in FIGS. 9-13, the tower rack 10 may include more than one tower rack 10. In such versions, multiple tower racks 10, each with its own spinning member 66 and spinning cap 70, are housed within a common fixed base 64 and header 72. The number of tower racks 10 housed within the common fixed base 64 is virtually unlimited and may range from 2 to 14 or more. Preferably, the configuration of the tower rack 10 within the base 64 is no more than two deep at any one point so that each tower rack assembly 15 can be accessed.

The spinning tower rack 10 may further include a lower intermediate spinning member and an upper intermediate spinning member (not shown). The lower intermediate spinning member is positioned between the spinning member 66 and the fixed member 68. The lower intermediate spinning member is rotationally connected to both the spinning member and the fixed member. The upper intermediate spinning member is positioned between the spinning cap 70 and the header 72. The upper intermediate spinning member is rotationally connected to both the spinning cap 70 and the header 72. The upper intermediate spinning member may contain locator-pin receiving holes for receiving the locator pin of the spinning caps 70. The upper intermediate spinning member may also itself include a locator pin for inserting in the locator-pin receiving holes of the header 72. However, other rotational connections known in the art may be used. The combination of the primary spinning unit (spinning member 66, tower prism 20, and spinning cap 70 in combination) and upper and lower intermediate spinning members 70,72 are referred to herein as a secondary spinning unit.

The spinning tower racks 10 described herein may further include support posts. These support posts are preferred in versions combining primary and secondary spinning units and provide support between the upper and lower intermediate spinning members. The support posts also provide a means of rotating the intermediate members with respect to the fixed members.

Figure 11:
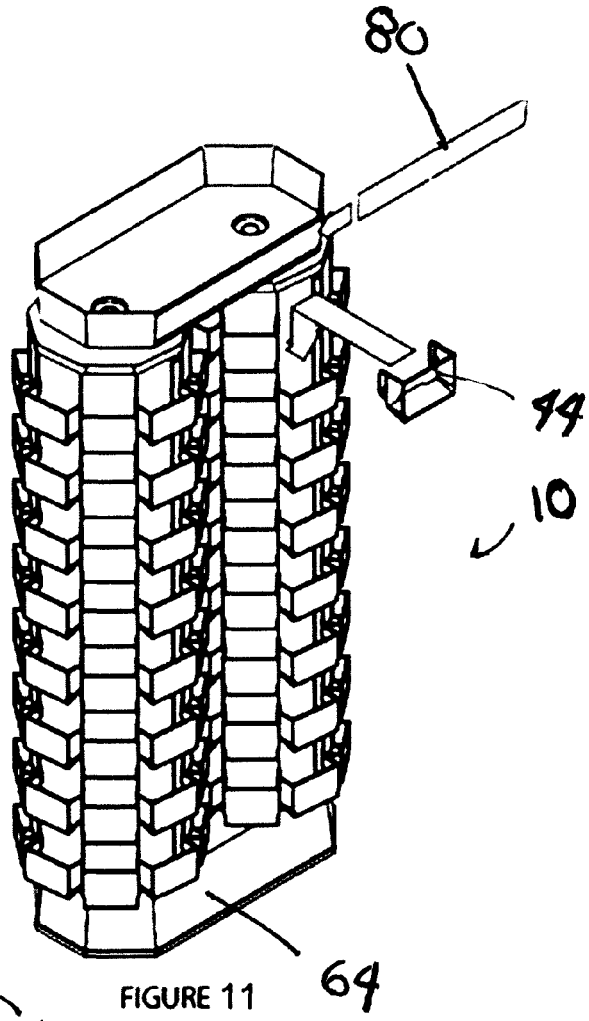
FIG. 11 is a perspective view illustrating the spinning tower rack of FIG. 9 with additional component features.

The spinning tower rack 10 may include informational displays 80 for displaying information such as branding, graphical images, etc. The informational displays 80 may be incorporated into the header 72, as shown in FIG. 11, or the fixed member 68 of the spinning base 64. The informational displays 80 may also be placed on the top of the cap 62 as shown in FIG. 6. In yet other versions, the spinning tower rack 10 may display information such as branding, graphical images, etc. on the outer surface of the tower prism 20 itself.

The spinning tower rack 10 may further include casters on the bottom of the base 64 (not shown).

Any version of any component or method step of the invention may be used with any other component or method step of the invention. The elements described herein can be used in any combination whether explicitly described or not.

As used herein, the singular forms "a," "an," and "the" include plural referents unless the content clearly dictates otherwise.

Numerical ranges as used herein are intended to include every number and subset of numbers contained within that range, whether specifically disclosed or not. Further, these numerical ranges should be construed as providing support for a claim directed to any number or subset of numbers in that range. For example, a disclosure of from 1 to 10 should be construed as supporting a range of from 2 to 8, from 3 to 7, from 5 to 6, from 1 to 9, from 3.6 to 4.6, from 3.5 to 9.9, and so forth.

The devices and methods of the present invention can comprise, consist of, or consist essentially of the essential elements and limitations described herein, as well as any additional or optional steps, ingredients, components, or limitations described herein or otherwise useful in the art.

It is understood that the invention is not confined to the particular construction and arrangement of parts herein illustrated and described, but embraces such modified forms thereof as come within the scope of the following claims.

What is claimed is:

1. A tower rack assembly for holding merchandise comprising:

a plurality of separate panel sections configured to be contiguously conjoined in an end-to-end manner to form a radially symmetrical tower assembly structure having an open first upper end and an open second lower end, wherein each of the plurality of panel sections comprises:

a first vertical edge and a second vertical edge, wherein the first vertical edge on each of the plurality of panel sections comprises a substantially flat flap, wherein the plurality of panel sections form the tower assembly when the flap on the first vertical edge of each of the plurality of panel sections overlaps with the second vertical edge of an adjacent panel section of the plurality of panel sections;

at least two contiguous, substantially flat side panels between the first vertical edge and the second vertical edge, wherein a first of the at least two contiguous, substantially flat side panels is contiguous with the flap of the first vertical edge, and wherein each of the at least two contiguous, substantially flat side panels and the flap are disposed at an angle with respect to each other;

a first vertical border demarcating the first of the at least two contiguous, substantially flat side panels from the flap;

at least one second vertical border, each second vertical border demarcating one of the at least two contiguous, substantially flat side panels from a contiguous one of the at least two contiguous, substantially flat side panels; and vertical slits defined periodically within the panel section along a vertical length of the first vertical border and along a vertical length of the at least one second vertical border, wherein the vertical slits comprise openings within the vertical borders; and one or more removable trays that are reversibly attachable to the side panels, wherein the one or more removable trays each include first and second side hooks that are configured to insert into the vertical slits, wherein a first of the one or more removable trays is capable of simultaneously attaching to two different panel sections of the plurality of panel sections when the plurality of panel sections are conjoined to form the tower assembly structure such that:

the first side hook of the first removable tray inserts into a vertical slit defined within the first vertical border of a first of the plurality of panel sections; and the second side hook of the first removable tray simultaneously inserts into a vertical slit defined within a first of the at least one second vertical border of a second of the plurality of panel sections.

2. A tower rack assembly for holding merchandise comprising:

a plurality of separate panel sections configured to be contiguously conjoined in an end-to-end manner to form a radially symmetrical tower assembly structure having an open first upper end and an open second lower end, wherein each of the plurality of panel sections comprises:

a first vertical edge and a second vertical edge, wherein the first vertical edge on each of the plurality of panel sections comprises a substantially flat flap, wherein the plurality of panel sections form the tower assembly when the flap on the first vertical edge of each of the plurality of panel sections overlaps with the second vertical edge of an adjacent panel section of the plurality of panel sections;

at least two contiguous, substantially flat side panels between the first vertical edge and the second vertical edge, wherein a first of the at least two contiguous, substantially flat side panels is contiguous with the flap of the first vertical edge, and wherein each of the at least two contiguous, substantially flat side panels and the flap are disposed at an angle with respect to each other;

a first vertical border demarcating the first of the at least two contiguous, substantially flat side panels from the flap;

at least one second vertical border, each second vertical border demarcating one of the at least two contiguous, substantially flat side panels from a contiguous one of the at least two contiguous, substantially flat side panels; and vertical slits defined periodically within the panel section along a vertical length of the first vertical border and along a vertical length of the at least one second vertical border, wherein the vertical slits comprise openings within the vertical borders; and one or more removable trays that are reversibly attachable to the side panels, wherein the one or more removable trays each include first and second side hooks that are configured to insert into the vertical slits, wherein a first of the one or more removable trays is capable of simultaneously attaching to two different panel sections of the plurality of panel sections when the plurality of panel sections are conjoined to form the tower assembly structure such that:

the first side hook of the first removable tray inserts into a vertical slit defined within the first vertical border of a first of the plurality of panel sections; and the second side hook of the first removable tray simultaneously inserts into a vertical slit defined within a first of the at least one second vertical border of a second of the plurality of panel sections, and wherein a second of the one or more removable trays is capable of simultaneously attaching to the second of the plurality of panel sections when the first removable tray is attached to the two different panel sections such that:

the first side hook of the second removable tray and the second side hook of the first removable tray simultaneously insert into the vertical slit defined within the first of the at least one second vertical border; and the second side hook of the second removable tray inserts into a vertical slit of a second of the at least one second vertical border.

3. A tower rack assembly for holding merchandise comprising:

a plurality of separate panel sections configured to be contiguously conjoined in an end-to-end manner to form a radially symmetrical tower assembly structure having an open first upper end and an open second lower end, wherein each of the plurality of panel sections comprises:

a first vertical edge and a second vertical edge, wherein the first vertical edge on each of the plurality of panel sections comprises a substantially flat flap, wherein the plurality of panel sections form the tower assembly when the flap on the first vertical edge of each of the plurality of panel sections overlaps with the second vertical edge of an adjacent panel section of the plurality of panel sections;

at least two contiguous, substantially flat side panels between the first vertical edge and the second vertical edge, wherein a first of the at least two contiguous, substantially flat side panels is contiguous with the flap of the first vertical edge, and wherein each of the at least two contiguous, substantially flat side panels and the flap are disposed at an angle with respect to each other;

a first vertical border demarcating the first of the at least two contiguous, substantially flat side panels from the flap;

at least one second vertical border, each second vertical border demarcating one of the at least two contiguous, substantially flat side panels from a contiguous one of the at least two contiguous, substantially flat side panels; and vertical slits defined periodically within the panel section along a vertical length of the first vertical border and along a vertical length of the at least one second vertical border, wherein the vertical slits comprise openings within the vertical borders; and one or more removable trays that are reversibly attachable to the side panels, wherein the one or more removable trays each include first and second side hooks that are configured to insert into the vertical slits, wherein the one or more removable trays comprises a plurality of removable trays, wherein the removable trays are capable of attaching about a perimeter of the tower assembly structure when the plurality of panel sections are conjoined to form the tower assembly structure such that:

each of the vertical slits simultaneously receives the first side hook of a first removable tray and the second side hook of a second removable tray therein; and at least one of the plurality of removable trays spans two different panel sections of the plurality of panel sections with the first side hook inserted in a vertical slit of a first of the plurality of panel sections and the second side hook inserted into a vertical slit of a second of the plurality of panel sections.

4. The tower rack assembly of claim 3 wherein:

each of the plurality of panel sections comprises horizontal slits defined periodically within the panel section along a vertical length of the side panels;

the horizontal slits and the vertical slits are positioned such that two vertical slits correspond with at least one horizontal slit, with the two vertical slits being placed above and on each side of the at least one horizontal slit;

the trays include a front surface, a bottom flap with a flange, and two side flaps, with each side flap containing either the first side hook or the second side hook; and the trays are configured to attach to the side panels by inserting the side flaps into the two vertical slits, sliding the tray downward so that the hooks engage a portion of the side panel underneath the two vertical slits, and inserting the flange into the horizontal slit.

5. The tower rack assembly of claim 1 wherein each of the plurality of panel sections comprises horizontal slits defined periodically within the panel section along a vertical length of the side panels.

6. The tower rack assembly of claim 5, wherein the horizontal slits and the two vertical slits are positioned such that two vertical slits correspond with at least one horizontal slit, with the two vertical slits being placed above and on each side of the at least one horizontal slit.

7. The tower rack assembly of claim 6, wherein the trays include a front surface, a bottom flap with a flange, and two side flaps, with each side flap containing a side hook.

8. The tower rack assembly of claim 7, wherein the trays are configured to attach to the side panels by inserting the side flaps into the two vertical slits, sliding the tray downward so that the hooks engage a portion of the side panel underneath the two vertical slits, and inserting the flange into the horizontal slit.

9. The tower rack assembly of claim 7, wherein the trays comprise at least two compartments for holding merchandise.

10. The tower rack assembly of claim 1, wherein the tower assembly forms a columnar shape.

11. The tower rack assembly of claim 1, wherein each of the plurality of panel sections includes three vertically arranged contiguous side panels.

12. The tower rack assembly of claim 1, further comprising a cap configured to fit over the open first upper end of the tower assembly structure.

13. The tower rack assembly of claim 12, wherein the cap is a spinning cap.

14. The tower rack assembly of claim 1, further comprising a base connected to the open second lower end of the tower assembly structure.

15. The tower rack assembly of claim 14, wherein the base is a spinning base, the spinning base including a spinning member rotationally connected to a fixed member on the base.

16. The tower rack assembly of claim 1 further comprising an information display post, wherein the information display post is located on a header.

17. The tower rack assembly of claim 1, wherein the panel sections are capable of forming two or more radially symmetrical tower assembly structures, each of the two or more tower assembly structures being rotationally connected to a common base.

18. The tower rack assembly of claim 1 further comprising a series of apertures disposed along a vertical length of the flap of each of the plurality of panel sections and a corresponding series of apertures disposed along a vertical length of the second vertical edge on each of the plurality of panel sections, wherein the apertures in each first vertical edge and the apertures in each second vertical edge are in registration when the plurality of panel sections are conjoined to form the tower assembly.

* * * * *